United States Patent [19]

Ribas et al.

[11] Patent Number: 4,475,303

[45] Date of Patent: Oct. 9, 1984

[54] PAD FOR LAUNCHING TOY VEHICLES ONTO A TRACK

[75] Inventors: Jean-Louis Ribas, Saint-Priest; Gilbert Chenavier, Caluire, both of France

[73] Assignee: Majorette S.A., Caluire, France

[21] Appl. No.: 446,301

[22] Filed: Dec. 2, 1982

[30] Foreign Application Priority Data

Dec. 11, 1981 [FR] France ..... 81 23352

[51] Int. Cl.[3] ..... A63H 18/00

[52] U.S. Cl. ..... 446/429

[58] Field of Search ..... 46/1 K, 201, 202, 204, 46/206, 209

[56] References Cited

U.S. PATENT DOCUMENTS 3,509,662 5/1970 Lunzer ..... 46/202 X
3,585,751 6/1971 Beny ..... 46/1 K
3,599,365 8/1971 Carver ..... 46/1 K X
3,600,849 8/1971 Faller ..... 46/1 K X

*Primary Examiner*—Robert A. Hafer
*Assistant Examiner*—William H. Honaker
*Attorney, Agent, or Firm*—Dowell & Dowell

[57] ABSTRACT

The invention relates to a pad for launching toy vehicles whose motors have been previously energized onto a track, comprising a plate provided with an annular runway on which the vehicles are placed, and a turnstile having arms which separate the vehicles and constitute a stop for each of them. A pawl stops the turnstile from rotating. Retraction of this pawl by action on its rod permits, due to the fact that the drive wheels of each vehicle are providing torque, rotation of the turnstile which thus releases the first vehicle. The rotation of the turnstile causes return into blocking position of the pawl whose rod is then extended in a position to be actuated by a vehicle finishing its run on the track. The invention is particularly applicable to games and toys.

6 Claims, 7 Drawing Figures

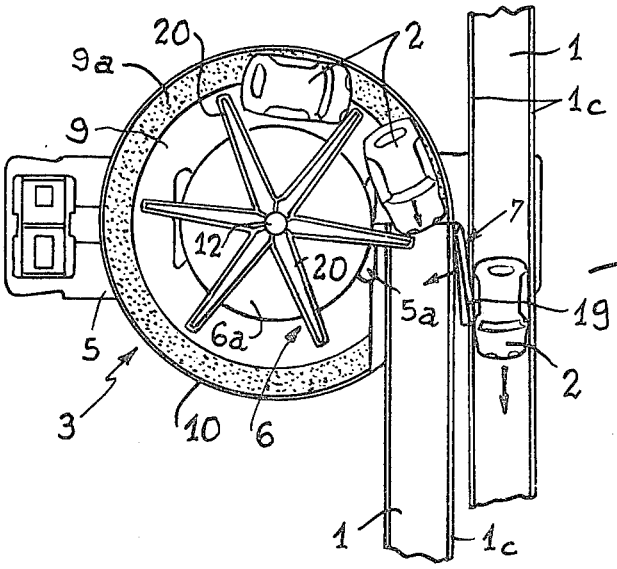
Fig. 4
Fig. 5
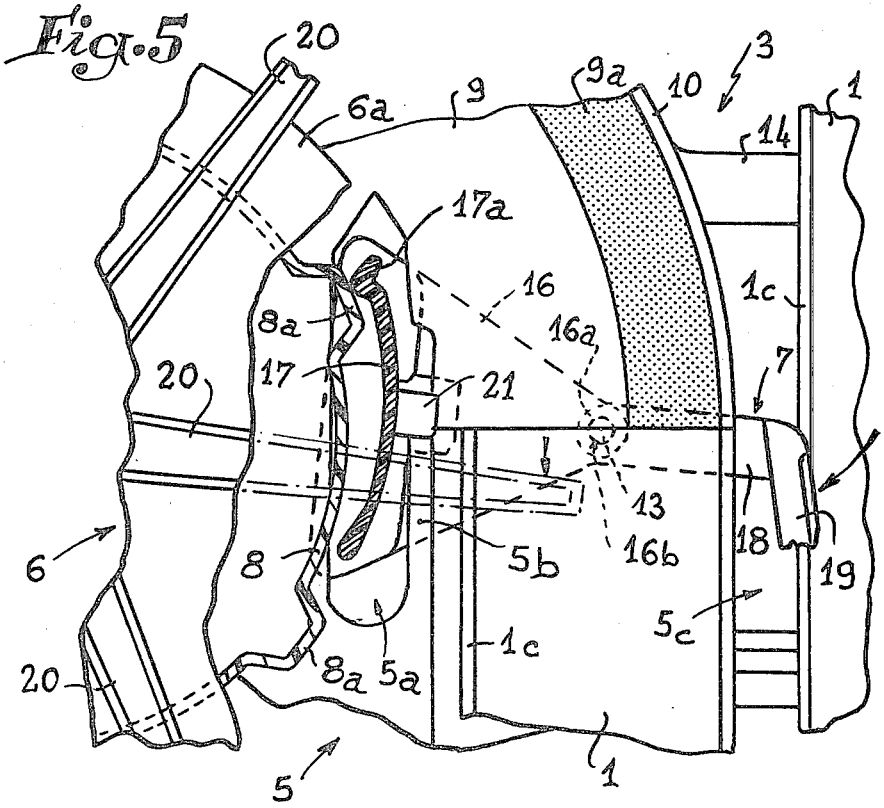

PAD FOR LAUNCHING TOY VEHICLES ONTO A TRACK

The present invention relates to a pad for launching toy vehicles having motors which are energized to drive the wheels of one axle of a torque.

It will firstly be noted that the toy vehicles in question are more generally, although not exclusively, miniature cars provided with a mechanical motor of any type, i.e. wound up by a key or by repeated friction on the floor, or provided with an electric motor supplied by batteries or the like.

It is known that, to render the movement of such a toy vehicle more interesting, it is made to move along a track comprising sharp bends and spirals. However, the child is obliged to place the vehicle at the start of the track and to decide when it will start off.

With a view to increasing the interest value of the tracks in question, the invention proposes a launching pad for successively launching several vehicles, the energy necessary for the operation of said pad being the potential energy of each vehicle whose motor has been previously energized by being wound or switched on to provide torque to the drive wheels.

The pad according to the invention is charaterized in that it comprises a circular plate on which are placed toy vehicles, of which the drive wheels are supplying torque, a turnstile centred on said plate the arms of which constitute a stop for the vehicles, means being provided for blocking rotation of the turnstile on the one hand and for releasing it on the other hand so that it can rotate under the thrust of the vehicles to enable one of them to escape the retaining action of the corresponding arm and to be launched onto the track associated with said plate. The vehicle following the one which has just moved onto the track is then ready to leave as soon as the previous one has finished its lap and has actuated the above-mentioned release means.

The invention will be more readily understood on reading the following description with reference to the accompanying drawings, in which:

FIG. 4 is a partial plan view which shows how a toy vehicle acts on the rod of the pawl of the pad according to the invention, to enable another vehicle to be launched onto the track.

FIG. 5 is a view similar to that of FIG. 2 but which corresponds to the position of the turnstile illustrated in FIG. 4, i.e. when the pawl having been displaced by a vehicle releases the toothed rim of the turnstile.

Figure 1:
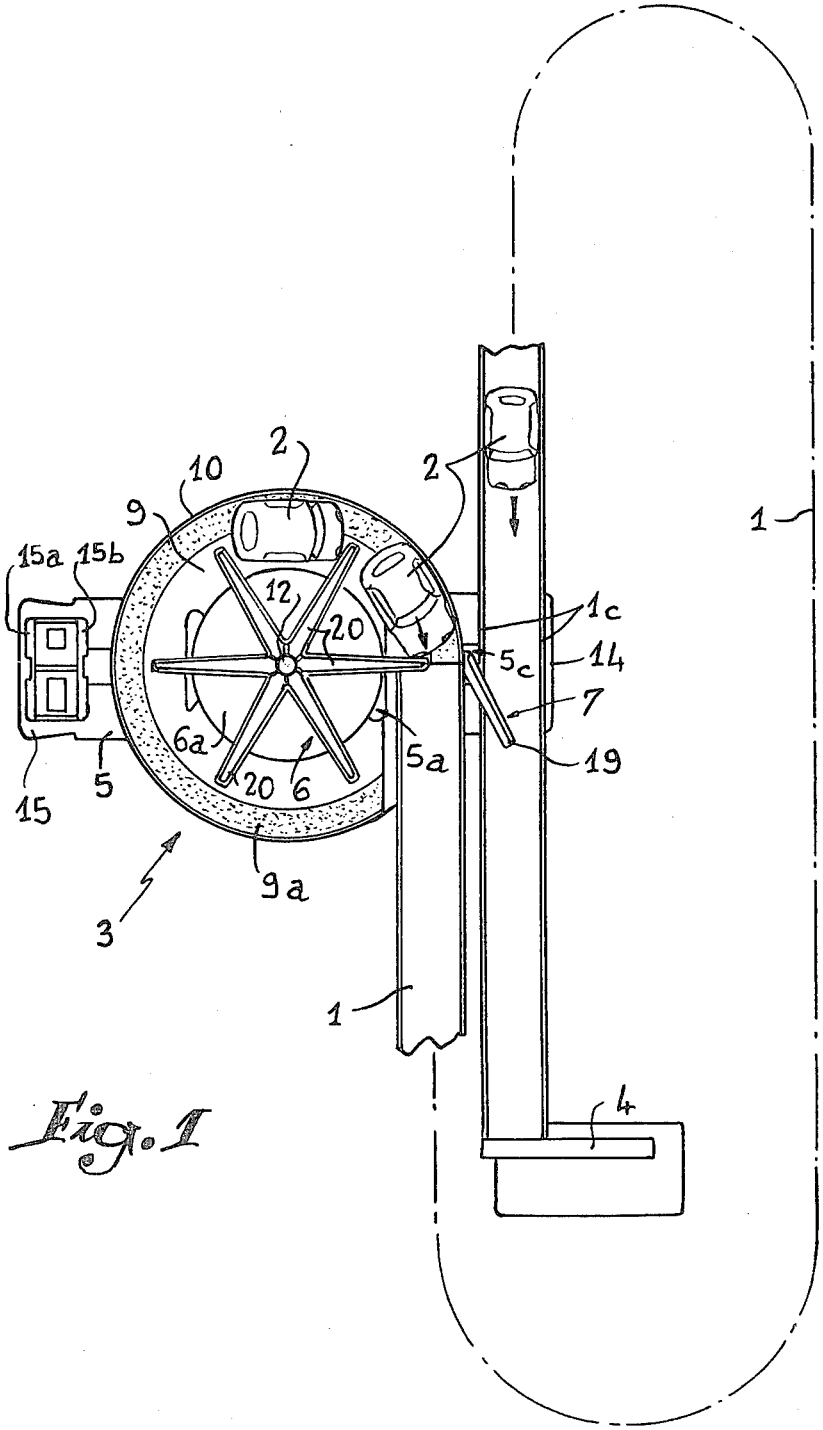
FIG. 1 is a plan view of a launching pad according to the invention, associated with a track for toy vehicles.

Referring now to the drawings, FIG. 1 shows a track 1 composed of track elements joined end to end and on which toy vehicles such as miniature cars 2 can circulate. The track 1 starts from a launching pad 3 constructed according to the invention and it terminates in a buffer stop 4 against which the vehicle 2 which goes arond the track 1 abuts at the end of the run.

The pad 3 essentially comprises a circular plate 5 with respect to the centre of which is mounted, to rotate freely, a turnstile 6 comprising six arms in the example shown. The pad 3 further comprises a pawl 7 adapted to act on a toothed rim 8 (FIG. 2) fixed to the underside of the turnstile 6.

The circular plate 5 comprises an annular runway 9 bordered by a vertical wall 10, the part of the runway 9 located in the immediate vicinity of the wall 10 comprising a rough surface 9*a* as will be more readily explained hereinafter. The centre of the plate 5 is provided with an upwardly oriented journal 11, FIG. 3, on which is engaged the opening 12*a* of a boss 12 arranged at the centre of the turnstile 6.

Figure 3:
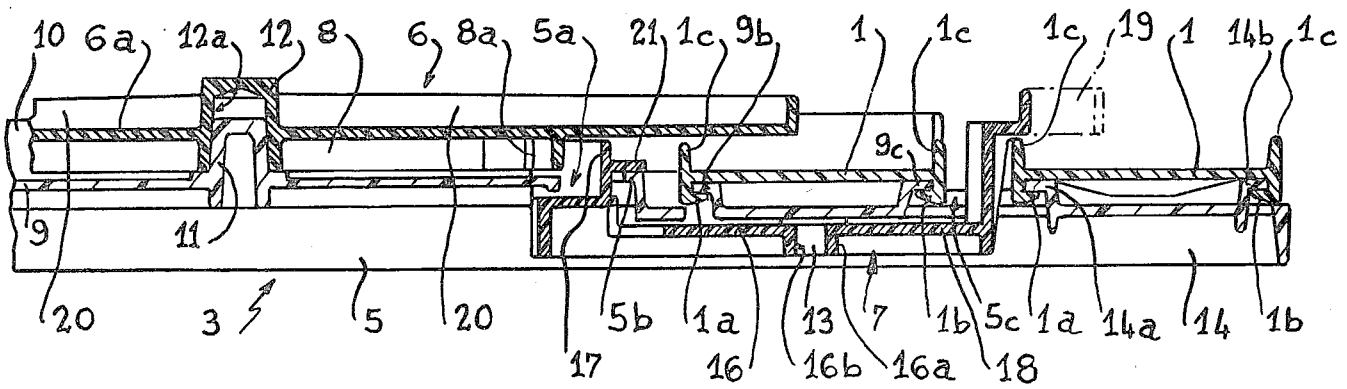
FIG. 3 is a section thereof along III—III (FIG. 2).
Figure 6:
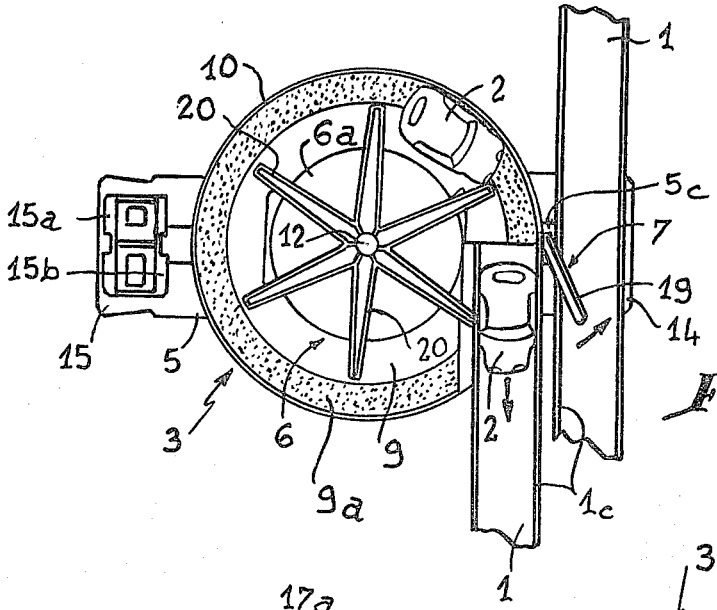
FIG. 6 is a view similar to that of FIG. 4 illustrating the turnstile in the course of rotation.

It will be observed in FIG. 1 that the annular runway 9 is interrupted so that one of the elements of the track 1 can be tangentially attached with respect to the runway 9. To this end, the latter comprises in the zone in question as shown in FIG. 3 to rails 9*b*, 9*c* around which is engaged a groove 1*a* or 1*b* respectively, formed on the lower face of each element of the track 1. One of the flanges 1*c* of this track element extends the peripheral wall 10 of the plate 5 as shown in FIG. 1. The lower face of the part of the runway 9 provided with rails 9*b* and 9*c* carries a downwardly facing pivot 13.

Outside its wall 10, the plate 5 comprises two projections 14–15 each provided with rails 14*a*, 14*b* or 15*a*, 15*b* respectively, FIGS. 1 and 3, oriented parallel to the rails 9*b* and 9*c*. Because of the shape in cross section of the track 1, the end thereof cooperates with one or the other of these projections. In the example illustrated, the end of track 1 is connected to projection 14.

The pawl 7, which is made in stepped manner, firstly comprises a central arm 16 of triangular form in plan, FIGS. 3 and 5, of which the apex comprises a boss 16*a* in the central bore 16*b* of which penetrates the pivot 13 of the plate 5. The end of this arm opposite the apex is shaped so as to constitute a ramp 17 of which one of the ends is made in the form of a head 17*a*. Opposite the ramp 17, the arm 16 is extended by a leg 18 to a rod 19 oriented obliquely with respect to this leg.

The turnstile 5 comprises a flat disc 6*a* on the top of which its arms 20 are placed, whilst the toothed rim 8, fixed to the lower face of said disc, is made in the form of a corrugated rim having six teeth 8*a* with oblique lateral faces. The diameter of the toothed rim 8 is such that, when the pawl 7 is in free position, FIG. 2, its head 17*a* constitutes a stop for one of the teeth 8*a* of said rim. In this position of the pawl, its rod 19 extends above the projection 14 of the plate 5, so that it is located just above the track 1 when the latter is associated with said projection. It will be noted that the portion located between the arm 16 and the ramp 17 of the pawl 7 passes through an opening 5*a* in the plate 5 and that, at this level, this portion is provided with a horizontal tab 21 which rests on an area 5*b* of said plate so as to maintain the pawl engaged about the pivot 13. FIG. 3 clearly shows that the rod 19 of the pawl extends above the corresponding flange 1*c* of the track 1, said rod including a vertical part which passes through another opening 5*c* in the plate 5.

Of course, the diameter of the plate 5 and the number of arms of the turnstile 6 are determined so that one miniature toy vehicle can be placed on the annular runway 9 between each pairs of arms of the turnstile.

Operation follows from the foregoing explanations.

Figure 2:
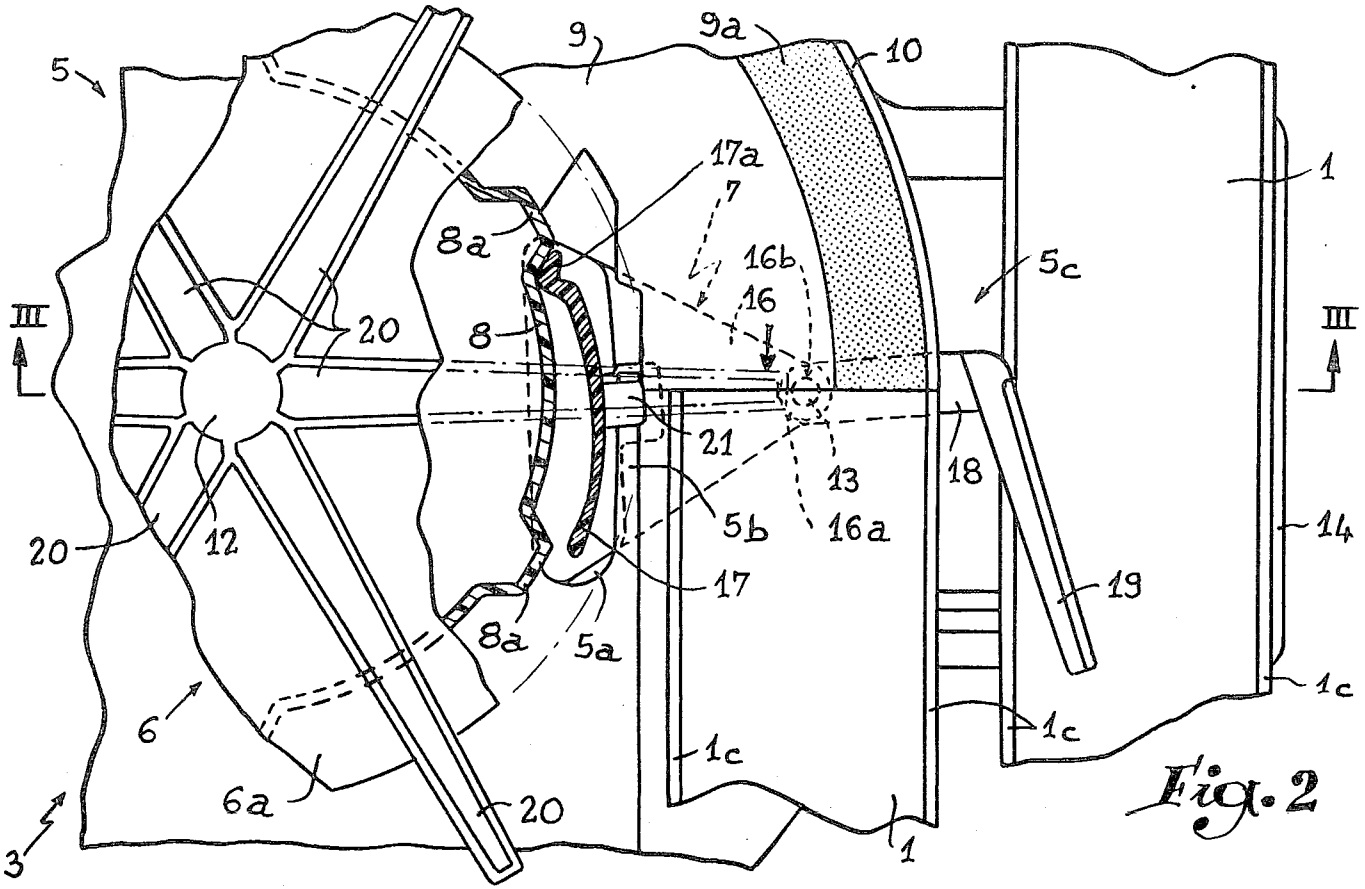
FIG. 2 is a partial view on a larger scale of the pad according to the invention, with parts broken away in order to show the manner in which the pawl acts on the toothed rim of the turnstile.
Figure 7:
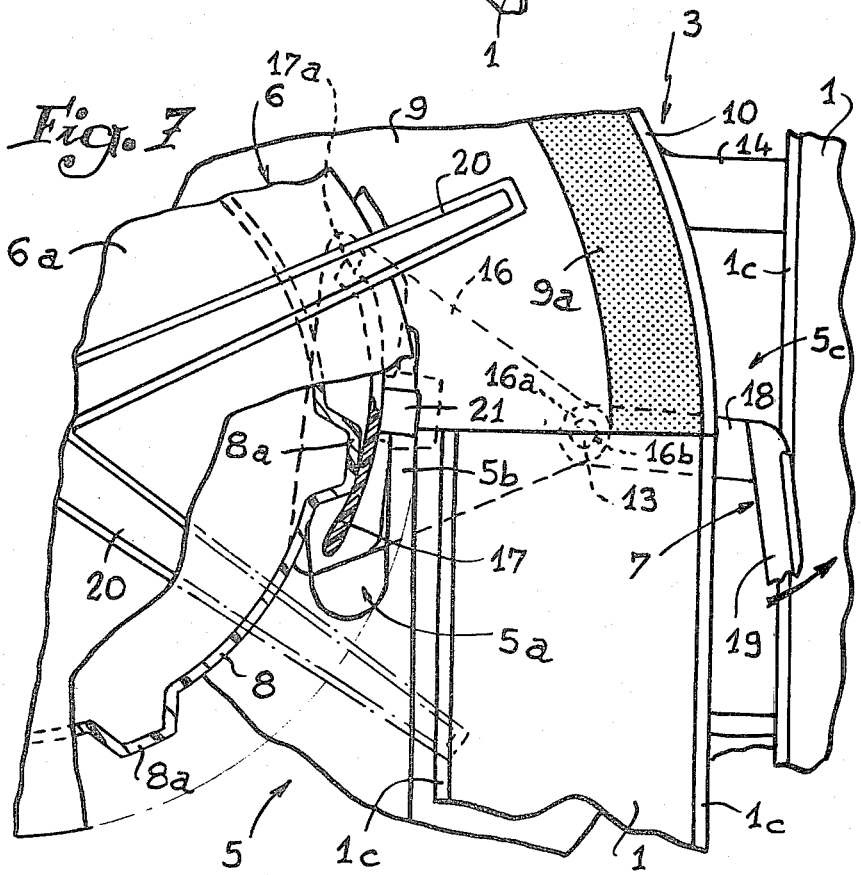
FIG. 7 is a view similar to that of FIG. 5 and corresponding to FIG. 6, showing the toothed rim of the turnstile at the moment when one of its teeth returns the pawl into initial position as illustrated in FIG. 2.

When the pawl is in the position illustrated in FIG. 2, i.e. when its rod 19 lies above the track, at least one and preferably five toy vehicles 2 are placed between the arms 20 of the turnstile, only the space located at the level of rails 9*b*, 9*c* of the annular runway 9 having no vehicle placed thereon. Of course, the drive wheels of all the vehicles are supplying thrust because their motors have previously been energized by being wound up or switched on if they are electric ones. Since the front of each vehicle abuts against one of the arms of the turnstile, these vehicles cannot advance and nor can they cause rotation of the turnstile because one of the teeth of the rim 8 is in abutment against the head 17*a* of the ramp of the pawl. As has been seen before, the rod 19 of the pawl lies across the track 1. Assuming, as in FIG. 1, that a toy vehicle 2 is approaching on the track in the direction of the buffer stop 4, when it makes contact with the rod 19, FIG. 4, it causes the pawl to pivot about 13 to the position shown in FIG. 5, with the result that the tooth which was in abutment thereon is released (FIG. 5). Due to the driving action of the wheels of the vehicles, the turnstile begins to rotate so that the first vehicle of the series placed on the annular runway 9 is no longer held back by the corresponding arm 20 and can be launched onto the track, whilst the vehicles which follow it continue to cause the turnstile to rotate. As illustrated in FIG. 7, the tooth 8*a* which has just been released from the hold exerted by the pawl comes into cooperation with the terminal part of the ramp 17 so as at 17*a* to tip the pawl about the pivot 13, so that the following tooth comes into abutment against the head 17*a* of the pawl (position illustrated in FIG. 2). Of course, the rod 19 of the pawl returns into position across the track.

When the vehicle which has just been launched onto the track actuates the rod 19 of the pawl on passing even with the launching pad, the following vehicle is launched in turn onto the track and so on, until the last vehicle has been released by the turnstile.

Of course, duplicate openings 5*a* and 5*c* are also made at the projection 15 on the other side of the plate 5, FIG. 1, so that the pawl 7 can be mounted at that spot, a second pivot 13 also being made on the lower face of the circular plate 5.

It will be readily understood that that part 9*a* of the runway 9 which has a crackle finish may be made by means of another type of surface with high coefficient of friction or may be constituted by separate, individual skids placed beneath the drive wheels of the vehicles, it being important to prevent the drive wheel of each vehicle placed on this surface from spinning.

It must be understood that the foregoing description has been given only by way of example and that it in no way limits the domain of the invention, replacement of the details of execution described by any other equivalents not departing from the scope thereof.

What is claimed is:

1. Apparatus for successively launching multiple toy vehicles each having a motor previously energized to provide torque to the vehicle drive wheels tending to thrust the vehicle onto a track from a launching pad, comprising:

(a) a track;

(b) a pad comprising a circular plate around which the energized vehicles are placed, the plate having means for fixing a portion of the track to the plate;

(c) a turnstile rotatably mounted at the center of the plate and having multiple outwardly-extending arms respectively separating the vehicles located around the plate, each vehicle thrusting against one of the arms in an effort to rotate the turnstile; and (d) pawl means fixed with respect to the plate and operative in a blocking position to block rotation of the turnstile to oppose the thrust of the vehicles thereagainst, and the pawl means having means overlying the track at a location which is remote from the circular plate and responsive to the passage of a vehicle along the track to move the pawl means to a releasing position in which it unblocks the turnstile to allow passage of one arm past said portion of the track, whereby to permit the vehicle thrusting against that arm to launch onto the track.

2. Apparatus as set forth in claim 1, wherein said turnstile has a rim fixed to and rotatable therewith, the rim having a tooth corresponding with each turnstile arm, and said pawl means having a tooth-engaging head portion located opposite the rim and having a rod comprising said means overlying the track, whereby when a vehicle moving along the track displaces said rod, the pawl is moved to said releasing position in which the head portion releases a tooth of the rim allowing the turnstile to be rotated by the thrust of the vehicles.

3. Apparatus as set forth in claim 2, wherein said pawl means has a ramp portion adjacent to the head portion and located opposite the rim, whereby when the head portion releases a tooth, the tooth contacts the ramp portion of the pawl and moves it back again to said blocking position in which the head portion rests against the next tooth on the rim.

4. Apparatus as set forth in claim 2, wherein the plate carries pivot means pivotally supporting the pawl, the pawl having a tab extending from it and overlying a portion of the plate adjacent to the pivot means to retain the pawl thereon.

5. Apparatus as set forth in claim 4, wherein said circular plate has two means for fixing a portion of the track to the plate, the two means being located respectively on opposite sides of the plate for fixing the track in either location; and wherein the plate carries two pivot means respectively located adjacent to said two fixing means, whereby the pawl can be supported adjacent to whichever fixing means said track is fixed to.

6. Apparatus as set forth in claim 1, wherein the plate has a circular runway surface supporting said vehicles disposed between the arms of the turnstile, and said runway surface being roughened to provide a high coefficient of friction with respect to the vehicle drive wheels.

* * * * *